US010768553B2

(12) United States Patent
Berger et al.

(10) Patent No.: US 10,768,553 B2
(45) Date of Patent: Sep. 8, 2020

(54) LAYERS FOR RESISTANCE TO ADHESION OF INK

(71) Applicant: HP INDIGO B.V., Amstelveen (NL)

(72) Inventors: Shachar Berger, Ness Ziona (IL); Sagie Shanun, Ness Ziona (IL); Gilles Chriqui, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/603,804

(22) PCT Filed: Apr. 18, 2017

(86) PCT No.: PCT/EP2017/059175
§ 371 (c)(1),
(2) Date: Oct. 8, 2019

(87) PCT Pub. No.: WO2018/192639
PCT Pub. Date: Oct. 25, 2018

(65) Prior Publication Data

US 2020/0033760 A1 Jan. 30, 2020

(51) Int. Cl.
*G03G 15/10* (2006.01)

(52) U.S. Cl.
CPC ... *G03G 15/104* (2013.01); *G03G 2215/0872* (2013.01)

(58) Field of Classification Search
CPC ..... G03G 15/10; G03G 15/104
USPC ..... 399/237
See application file for complete search history.

(56) References Cited

U.S. PATENT DOCUMENTS

| | | | | |
|---|---|---|---|---|
| 5,761,581 | A | 6/1998 | Nojima | |
| 6,512,911 | B2 | 1/2003 | Arai et al. | |
| 7,356,287 | B2 | 4/2008 | Guzman et al. | |
| 8,086,142 | B2 | 12/2011 | Gilmartin et al. | |
| 8,428,495 | B2 | 4/2013 | Li | |
| 10,514,633 | B2 * | 12/2019 | Li et al. | G03G 15/10 |

(Continued)

FOREIGN PATENT DOCUMENTS

| | | |
|---|---|---|
| EP | 0726504 | 8/1996 |
| JP | 10177303 | 6/1998 |

(Continued)

OTHER PUBLICATIONS

Adamovic, Savka et al. "Feasibility of Electrocoagulation/flotation Treatment of Waste Offset Printing Developer Based on the Response Surface Analysis." Arabian Journal of Chemistry 9, No. 1 (2016): 152-162.

*Primary Examiner* — William J Royer
(74) *Attorney, Agent, or Firm* — HP Inc. Patent Department

(57) ABSTRACT

In one aspect an apparatus for use in an electrographic printer includes a tray defining a cavity, the tray having an internal surface, and an ink developer electrode disposed in the cavity for developing an ink. There is a first layer disposed on the internal surface, the first layer including a dielectric material, and a second layer disposed on the first layer, the second layer adhering to the first layer and being resistant to the adhesion of ink. In another aspect manufacturing such apparatus includes applying respective polymer precursor compositions to form the two layers and cross-linking the second polymer composition.

15 Claims, 8 Drawing Sheets

(56) References Cited

U.S. PATENT DOCUMENTS

| | | | |
|---|---|---|---|
| 2009/0080939 | A1 | 3/2009 | Sabo et al. |
| 2016/0200937 | A1 | 7/2016 | Hu et al. |

FOREIGN PATENT DOCUMENTS

| | | | |
|---|---|---|---|
| JP | 2009020198 | | 1/2009 |
| WO | WO-2013060377 | A1 | 5/2013 |

* cited by examiner

LAYERS FOR RESISTANCE TO ADHESION OF INK

BACKGROUND

An electrographic printing system may use digitally controlled lasers to create a latent image in a charged surface of a photo imaging plate (PIP). The lasers may be controlled according to digital instructions from a digital image file. Digital instructions typically include one or more of the following parameters: image color, image spacing, image intensity, order of color layers, etc. A printing substance may then be applied to the charged surface of the PIP, recreating a desired image. The image may then be transferred from the PIP to a transfer blanket on a transfer cylinder and from the transfer blanket to a desired substrate, which may be placed into contact with the transfer blanket by an impression cylinder. The printing substance may be applied to the surface of the PIP from one or more Binary Ink Development (BID) units.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Figure 1:
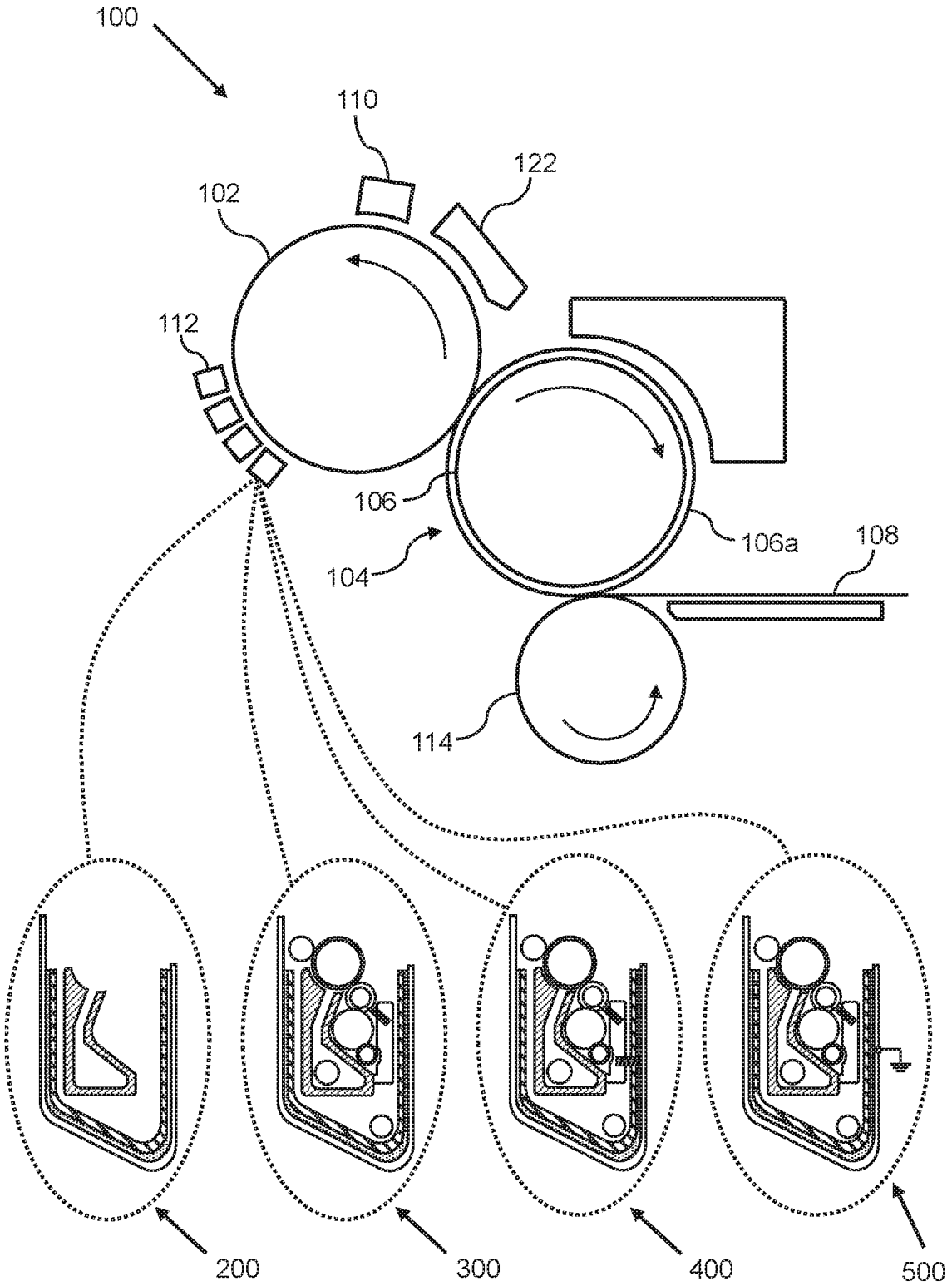
FIG. 1 is a schematic diagram showing an electrographic printer for use with examples of the present disclosure.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Electrographic printing (also referred to as electrophotographic printing) refers to a process of printing in which a printing substance (e.g., a liquid or dry electrographic ink or toner) can be applied onto a surface having a pattern of electrostatic charge. The printing substance conforms to the electrostatic charge to form an image in the printing substance that corresponds to the electrostatic charge pattern.

In some electrographic printers, a printing substance may be transferred onto a photo-imaging cylinder by one or more Binary Ink Developer (BID) units. In some examples, the printing substance may be liquid ink. In other examples the printing substance may be other than liquid ink, such as toner. In some examples, there may be one BID unit for each printing substance and/or printing substance color. During printing, the appropriate BID unit can be engaged with the photo-imaging cylinder. The engaged BID unit may present a uniform film of printing substance to the photo-imaging cylinder.

The printing substance may comprise electrically charged pigment particles that are attracted to oppositely charged electrical fields on the image areas of the photo-imaging cylinder. The printing substance may be repelled from the charged, non-image areas. The result may be that the photo-imaging cylinder is provided with the image, in the form of an appropriate pattern of the printing substance, on its surface. In other examples, such as those for black and white (monochromatic) printing, one or more BID units may alternatively be provided.

Particles of a printing substance may be referred to generally as ink particles (including particles in a liquid ink). Ink particles in the printer may be electrically charged such that they can be controlled when subjected to an electric field. Typically, the ink particles may be negatively charged and therefore repelled from the negatively charged portions of the photo imaging cylinder, and attracted to the discharged portions of the photo imaging cylinder.

BID units may comprise an electrode to provide an electric field in order to provide electric charge to the ink particles. Portions of the BID unit may interact with the electric field provided, thereby accumulating an electric charge.

In some cases, the accumulated electric charge may attract some of the particles in the BID unit. This attraction may provide for accumulation of ink particles in portions of the BID unit.

Ink particles may adhere to each other and to surfaces in the BID unit. For example, for liquid inks, portions of the liquid carrier of accumulated ink in the BID unit may evaporate, leaving ink particles to adhere to one another and to the surfaces of the BID unit, such as the inner surface of the BID unit. This accumulated ink may be referred to as sludge. Accumulation of sludge in a BID unit may substantially reduce the useful lifespan of a BID unit. Less sludge may accumulate in the BID units of the present disclosure, or they may have an extended lifespan.

Certain examples will now be described in more detail with reference to the Figures.

FIG. 1 shows an electrographic printer 100, for use with BID units of the present disclosure, to print a desired image. A desired image may be initially formed on a photoconductor using a printing substance, such as liquid ink. In the example shown, the photoconductor is a photo-imaging cylinder 102, but in other examples the photoconductor may be a photoconductive plate, belt, or other conductive element. The printing substance, in the form of the image, may then be transferred from the photo-imaging cylinder 102 to an intermediate surface, such as the surface of a transfer element 104. The photo-imaging cylinder 102 may continue to rotate, passing through various stations to form the next image.

In the example depicted in FIG. 1, the transfer element 104 can comprise a transfer cylinder 106 and a transfer blanket 106*a* surrounding the transfer cylinder 106, and the surface of the transfer element 104 can be a surface of the transfer blanket 106*a*. The transfer element 104 may otherwise be referred to as a transfer member 104. In other examples, transfer member 104 may comprise a continuous belt supporting a transfer blanket, or a continuous transfer blanket belt (wherein the transfer blanket is not disposed on a supporting member).

According to one example, an image may be formed on the photo-imaging cylinder 102 by rotating a clean, bare segment of the photo-imaging cylinder 102 under a photo charging unit 110. The photo charging unit 110 may include a charging device, such as corona wire, charge roller, or other charging device, and a laser imaging portion. A uniform static charge may be deposited on the photo-imaging cylinder 102 by the photo charging unit 110. As the photo-imaging cylinder 102 continues to rotate, the photo-imaging cylinder 102 can pass the laser imaging portion of the photo charging unit 110, which may dissipate localized charge in selected portions of the photo-imaging cylinder 102, to leave an invisible electrostatic charge pattern that corresponds to the image to be printed. In some examples, the photo charging unit 110 can apply a negative charge to the surface of the photo-imaging cylinder 102. In other examples, the charge may be a positive charge. The laser imaging portion of the photo charging unit 110 may then locally discharge portions of the photo imaging cylinder 102, resulting in local neutralized regions on the photo-imaging cylinder 102.

In this example, a printing substance may be transferred onto the photo-imaging cylinder 102 by one or more Binary Ink Developer (BID) units 112. In some examples, the printing substance may be liquid ink. In other examples the printing substance may be other than liquid ink, such as toner. In this example, there may be one BID unit 112 for each printing substance color. During printing, the appropriate BID unit 112 can be engaged with the photo-imaging cylinder 102. The engaged BID unit 112 may present a uniform film of printing substance to the photo-imaging cylinder 102. BID unit 112 may include an apparatus 200, 300, 400, 500, as described in the following paragraphs.

In this example, following the provision of the printing substance on the photo-imaging cylinder 102, the photo-imaging cylinder 102 may continue to rotate and transfer the printing substance, in the form of the image, to the transfer member 104. In some examples, the transfer member 104 can be electrically charged to facilitate transfer of the image to the transfer member 104.

Once the photo-imaging cylinder 102 has transferred the printing substance to the transfer member 104, the photo-imaging cylinder 102 may rotate past a cleaning station 122 which can remove any residual ink and cool the photo-imaging cylinder 102 from heat transferred during contact with the hot blanket. At this point, in some examples, the photo-imaging cylinder 102 may have made a complete rotation and can be recharged ready for the next image.

In some examples, the transfer member 104 may be disposed to transfer the image directly from the transfer member 104 to a substrate 108. In some examples, where the electrographic printer is a liquid electrographic printer, the transfer member 104 may comprise the transfer blanket 106*a* to transfer the image directly from the transfer blanket to the substrate 108. In other examples, a transfer component may be provided between the transfer member 104 and the substrate 108, so that the transfer member 104 can transfer the image from the transfer member 104 towards the substrate 108, via the transfer component.

In this example, the transfer member 104 may transfer the image from the transfer member 104 to the substrate 108 located between the transfer member 104 and an impression cylinder 114. This process may be repeated, if more than one colored printing substance layer is to be included in a final image to be provided on the substrate 108.

Figure 2:
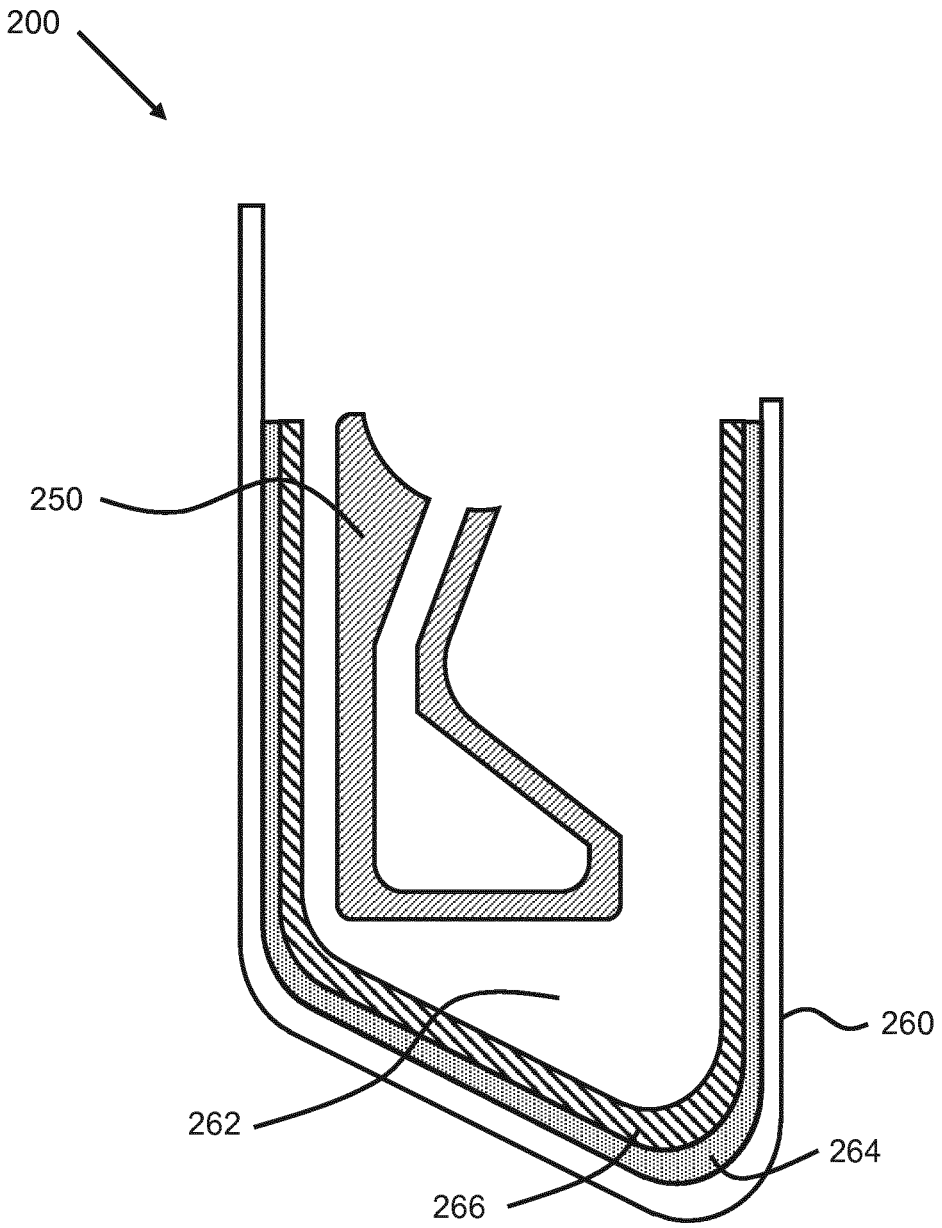
FIGS. 2, 3, 4, and 5 are schematic diagrams showing BID units according to examples of the present disclosure.

FIG. 2 shows the apparatus 200 according to an example of the present disclosure. The apparatus 200 is a BID unit. The apparatus 200 comprises a tray 260, defining a cavity 262. A surface of the tray 260 facing the cavity 262 may be referred to as the internal surface of the tray 260. Arranged in the cavity is an ink developer electrode 250. In some examples, the tray 260 may comprise a metal, such as aluminum.

Disposed on the internal surface of the tray 260 is a first layer 264. The first layer 264 comprises a dielectric material. A dielectric material may refer to a substance which entirely, substantially, or partially inhibits the flow of electrons. The dielectric material may have a low dielectric constant, for example the dielectric material may have a dielectric constant of from 1 to 4, or from 1.5 to 3.5, or from 2 to 3. In an example, the dielectric material may have a dielectric constant of less than or equal to 6, 5, 4, 3.5, 3, 2.5, or 2. In another example, the dielectric material may have a dielectric constant of greater than or equal to 1, 2, 2.5, 3, 3.5, 4, or 4.5.

The dielectric material of the first layer 264 may comprise a polymer composition. In some examples, the polymer composition may be an organic polymer, but in other examples the polymer may be inorganic (for instance, the polymer may be a silicone).

The polymer composition may comprise one polymer, or may comprise a plurality of polymers. In some examples, the polymer composition may be an electrical insulator. For instance, the polymer composition may comprise an epoxy polymer (also referred to as an epoxy resin).

The nature of a polymer composition may derive from the mixture of monomers or copolymers (both being referred to as components) used to make the polymer composition. A mixture of components from which a polymer may be obtained may be referred to as a polymer precursor composition. For example, a mixture of components from which an epoxy polymer may be obtained may be referred to as an epoxy precursor composition. Similarly, a mixture of components from which the polymer of the first layer 264 may be obtained may be referred to as a first polymer precursor composition. Components for providing some polymers are described below.

In some examples, the polymer composition may comprise an epoxy resin. Epoxy resins may comprise a component comprising an epoxy group (also referred to as an epoxy component). Epoxy resins may also comprise further components, these components being crosslinking agents, or "hardeners". These crosslinking agents may react with epoxy components to provide an epoxy resin. For example, an epoxy resin may be obtained from an epoxy precursor composition comprising an epoxy component and a crosslinking agent.

The epoxy component may be aromatic or aliphatic. The epoxy component may be a polyglycidyl ether of a polyol. For example, the epoxy component may be a polyglycidyl ether of a polyhydric phenol. In some examples, the epoxy component may comprise bisphenol A diglycidyl ether (BADGE of DGEBA), bisphenol F diglycidyl ether, novolacs (such as epoxy phenol novolacs (EPN) and epoxy cresol novolacs (ECN)), and combinations thereof. In an example, the epoxy component may comprise bisphenol A diglycidyl ether.

Epoxy components such as those discussed hereinabove may be prepared, for instance, from a diol or polyol and epichlorohydrin. For example, bisphenol A diglycidyl ether may be prepared from bisphenol and epichlorohydrin.

In some examples the epoxy component may itself be a polymer. For example, the epoxy component may comprise an oligomer or polymer of bisphenol A, said oligomer or polymer comprising an epoxy group.

The crosslinking agent may be any component which can react with an epoxide group. For example, the crosslinking agent may comprise an amine, imidazole, acid, acid anhydride, alcohol (including phenol), thiol, and combinations thereof.

In some examples, the crosslinking agent may comprise an amine. The crosslinking agent may comprise aliphatic, alicyclic, and/or aromatic amines, for example. Aliphatic amines may include diethylenetriamine, triethylenetetramine, tetraethylenepentamine, diproprenediamine, diethylaminopropylamine, N-aminoethylpiperazine, and mixtures thereof. Alicyclic amines include piperidine, N,N-dimethylpiperidine, triethylenediamine, diaminocyclohexane, bis-(dimethyyldiaminocyclohexyl) methane, bis-p-aminocyclohexylmethane, and mixtures thereof. Aromatic amines include methylene dianiline, m-phenylene diamine, metaphenylene diamine (MPDA), diaminodiphenylmethane (DDM, also known as methylene dianiline), and diaminodiphenylsulfone (DDS), and mixtures thereof.

In some examples, the crosslinking agent may comprise an imidazole. Imidazoles may include 2-methylimidazole, 2-ethyl-4-methylimidazole, In some examples, the crosslinking agent may comprise a bisphenol or a polyphenol. In an example, the crosslinking agent may comprise bisphenol A, novolac, and mixtures thereof. Bisphenol or polyphenol crosslinking agents may be used in examples wherein the epoxy precursor composition is a powder.

The epoxy polymer precursor composition may further comprise additives. For example, the epoxy polymer precursor composition may comprise titanium oxide, barium sulfate, calcium carbonate, a silicate, and combinations thereof. In some examples, such additives may be used as pigments. In some examples, such additives may be used as filler. Such additives may provide an epoxy polymer with increased electrical and/or thermal insulation properties.

In some examples, the first layer 264 may comprise an epoxy resin obtainable from a bisphenol or polyphenol, such as bisphenol A, bisphenol F, and/or novolac.

In an example, there are substantially no other components between the first layer 264 and the internal surface of the tray 260. For example, there may be no adhesive disposed between the first layer 264 and the internal surface of the tray 260. Alternatively or additionally, the internal surface of the tray 260 may be untreated; that is, a chemical treatment has not been carried out on the surface to make it more suitable for attaching to a composition.

In some examples, the first layer 264 may be of a substantially uniform thickness. In an example, the first layer 264 may have a thickness of from 1 μm to 1 mm, or from 5 μm to 500 μm, or from 10 μm to 250 μm, or from 50 μm to 200 μm, or from 100 μm to 150 μm. The first layer 264 may have a thickness or more than or equal to 1 μm, or 5 μm, or 10 μm, or 50 μm, or 100 μm, or 150 μm. The first layer 264 may have a thickness of less than or equal to 500 μm, or 250 μm, or 200 μm, or 150 μm, or 100 μm.

The first layer 264 may cover at least a portion of the internal surface of the tray 260. In an example, the first layer 264 covers a majority of the internal surface of the tray 260 by surface area, or at least 60%, 70%, 80%, or 90%.

The first layer 264 may have at least two surfaces—a first, external surface contacting the internal surface of the tray 260, and a second, internal surface facing the cavity 262.

A second layer 266 is disposed on the first layer 264. In an example, the second layer 266 is disposed on the internal surface of the first layer 264. The second layer 266 adheres to the first layer 264, whilst being resistant to the adhesion of ink. The second layer 266 may provide an internal surface facing the cavity 262, the internal surface being non-stick. For example, the internal surface of the second layer 266 may have a low surface energy. For example, the internal surface energy of the second layer 266 may have a surface energy less than or equal to 40 $mNm^{-1}$, 35 $mNm^{-1}$, 30 $mNm^{-1}$, 25 $mNm^{-1}$, or 20 $mNm^{-1}$. In an example, the internal surface of the second layer 266 may be non-wetting. For example, the contact angle of the internal surface of the second layer 266 with water may be greater than or equal to 90°, 95°, 100°, 105°, 110°, 115°, 120°, 125°, 130°, 135°, or 140°. In an example, the internal surface of the second layer 266 may have a low friction co-efficient.

The second layer 266 may comprise a polymer composition. In some examples, the polymer composition may be an organic polymer, while in other examples the polymer may be inorganic (for instance, the polymer may be a silicone).

The polymer composition may comprise one polymer, or may comprise a plurality of polymers. In some examples, the polymer composition may comprise a polyurethane, a polyester, a silicone (also referred to as a polysiloxane), and combinations thereof.

The polymer composition may or may not comprise a fluoropolymer, such as polytetrafluorethylene (PTFE), polyvinylfluoride (PVF), polyvinylidene fluoride (PVFD), perfluoroaloxy alkanes (PFA) etc. In one example, the polymer composition does not comprise a fluoropolymer.

The polymer composition of the second layer 266 may be obtained from a second polymer precursor composition. Components for providing some polymers are described below.

In some examples, the polymer composition may comprise a polyurethane. Polyurethane polymers may be obtained from combining polyols and di- or polyisocyanates. In some examples, the polyol component may comprise one or more of various polyols. Polyols may include polyester polyols, polyether polyols, polyolefin polyols, polycarbonate polyols and mixtures thereof. In some examples, the polyol component may comprise a hydroxyl-terminated polyester, obtainable from mixtures comprising a lactone and a polyol. A hydroxyl-terminated polyester may be obtainable, from mixtures comprising a polyol, an ester, and a diol, for example. The polyol may be linear or branched. In one example, the polyol component may comprise a linear, aliphatic hydroxyl-terminated polyester.

In some examples, the di- or polyisocyanate component may comprise monomeric and/or polymeric molecules. Di- or polyisocyanates may be aromatic or aliphatic. In some examples, the di- or polyisocyanate component may comprise an aromatic or aliphatic diisocyanate or polyisocyanate. Aliphatic diisocyanates include, but are not limited to, hexamethylene diisocyanate and isophorone diisocyanate. Aromatic diisocyanates include, but are not limited to, polymeric methylene diphenyl diisocyanate and toluene diisocyanate.

In some examples, the polymer composition may comprise a modified polyurethane, such as a silicone-modified polyurethane. For example, a polymer which is obtainable from a mixture of polyols, di- or polyisocyanates, and silicone monomers, oligomers or polymers.

Silicone-modified polyurethanes may be obtained from combining polyols and di- or polyisocyanates as described hereinabove with silicone components. Silicone components include, but are not limited to, poly(dimethylsiloxane) (PDMS), poly(dimethylsiloxane-co-diphenylsiloxane), or poly(dimethylsiloxane-co-methylphenylsiloxane). In some examples, the silicone component may comprise an hydroxyl-terminated silicone, such as a mono- or di-hydroxy-terminated silicone. For example, the PDMS may be an hydroxy-terminated PDMS, such as a mono- or dihydroxy-terminated PDMS.

The polymer composition of the second layer 266 may be crosslinked, or "cured". Components of a polymer precursor composition may crosslink to provide a polymer composition. In some examples, an external stimulus may be applied to the polymer precursor composition to provide a polymer composition. In other examples, components of a polymer precursor composition may crosslink without the application of an external stimulus.

In some examples, the second layer 266 may comprise polyurethane, polyester, silicone, and combinations thereof. In an example, the second layer 266 may comprise polyurethane. In a further example, the second layer 266 may comprise a silicone-modified polyurethane.

The second layer 266 may be of a substantially uniform thickness. In an example, the second layer 266 may have a thickness of from 0.1 μm to 500 μm, or from 0.5 μm to 250 μm, or from 1 μm to 100 μm, or from 10 μm to 50 μm, or from 20 μm to 30 μm. The second layer 266 may have a thickness or more than or equal to 0.1 μm, or 0.5 μm, or 1 μm, or 5 μm, or 10 μm, or 15 μm, or 20 μm, or 30 μm. The second layer 266 may have a thickness of less than or equal to 500 μm, or 250 μm, or 100 μm, or 50 μm, or 30 μm, or 20 μm, or 10 μm. In an example, the second layer 266 has a thickness less than the thickness of the first layer 264.

The second layer 266 may cover at least a portion of the internal surface of the first layer 264. In an example, the second layer 266 covers a majority of the internal surface of the tray 260 by surface area, or at least 60%, 70%, 80%, 90%, 95, or 98% by surface area. In an example, the second layer 266 covers substantially all of the internal surface of the first layer 264.

The combination of tray 260, first layer 264 and second layer 266 may be referred to as a layered structure. The layered structure may also be referred to as a sludge accumulation inhibitor.

Substantially less sludge may accumulate in apparatus 200, and/or sludge may accumulate much more slowly in apparatus 200, compared with a BID unit which does not comprise first and second layers 264 and 266. Accordingly, the useful lifespan of a BID unit corresponding to apparatus 200 may have a substantially longer lifespan than a BID unit which does not comprise first and second layers 264 and 266. Alternatively or additionally, a BID unit corresponding to apparatus 200 may operate more efficiently than a BID unit which does not comprise first and second layers 264 and 266.

In an example, the first layer 264 may comprise an epoxy resin, such as an epoxy resin obtainable from a bisphenol or polyphenol, and the second layer 266 comprises a polyurethane, such as a silicone-modified polyurethane.

Figure 3:
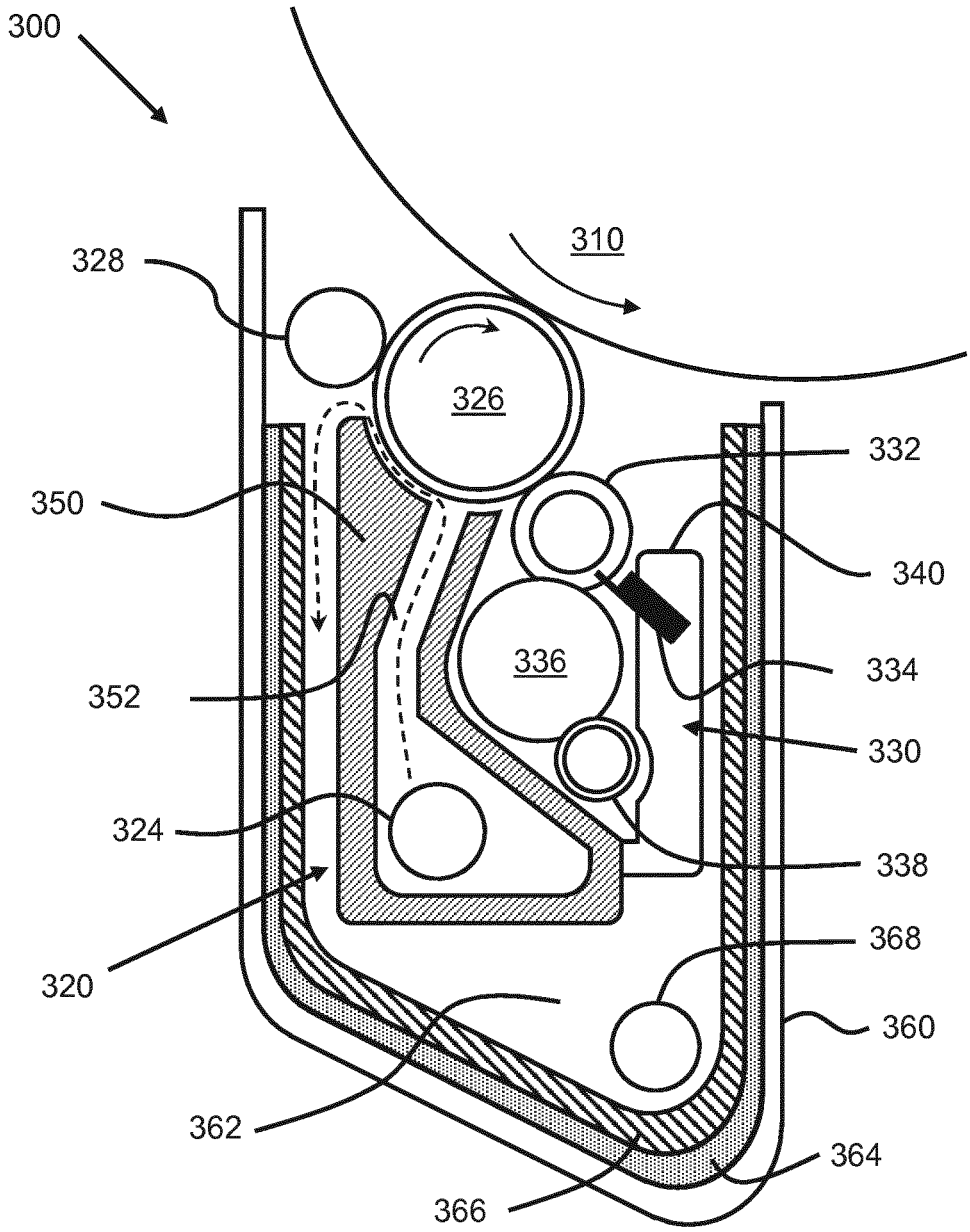

FIG. 3 shows an apparatus 300. For brevity, features in FIG. 3, the functions thereof that are the same as those features already described with reference to FIG. 2, are given similar reference numerals to those in FIG. 2 but increased by multiples of 100.

The apparatus 300 is a BID unit, and may comprise a developer unit 320. The developer unit 320 may comprise, for example, an ink inlet 324, an ink outlet 368, a developer roller 326, a squeegee roller 328, an ink developer electrode 350, and a tray 360. The tray 360 is arranged so as to define a cavity 362, and the internal surface of the tray 360 faces the cavity 362. In use, an ink can be introduced into the apparatus 300 through ink inlet 324 and travel through the BID unit as shown by the dashed arrow. Firstly, the ink may pass through channel 352 in the ink developer electrode 350, which may cause some of the ink particles to become charged. The ink may then pass between the ink developer electrode 350 and the developer roller 326, wherein some of the charged particles may be developed onto the surface of the developer roller 326. The ink disposed on the surface of the developer roller 326 may then be dispersed into a layer of more uniform thickness by the squeegee roller 328, and then transferred to a photo-imaging cylinder 310.

The apparatus 300 may also comprise a cleaning unit 330, which may include a cleaning roller 332, wiper 334, a sponge roller 336, and a squeezer roller 338. The wiper 334 may be supported by a wiper wall 340 in the cleaning unit 330. The cleaning unit 330 may be arranged such that, in use, residual ink left on the developer roller 326 after ink has been transferred to the photo-imaging cylinder 310 may be transferred to the cleaning roller 332. In turn, the sponge roller 336 may remove ink from the surface of the cleaning roller 332, and then the squeezer roller 338 may remove ink from the sponge roller 336. Wiper 334 may also be used to ensure that portions of the surface of the cleaning roller 332 are substantially free of ink before contacting the developer roller 326 again.

Ink which is not transferred to the developer roller 326 may accumulate in the cavity 362. For example, ink may accumulate between the ink developer electrode 350 and the inner surface of the tray 360, and/or in between the cleaning unit 330 and the inner surface of the tray 360, and/or on components of the cleaning unit 330. In an example, a portion of a liquid carrier in the accumulated ink may evaporate, leaving the ink particles to adhere to one another and the surfaces of the BID unit, such as the inner surface of the tray 360. This accumulated ink may be referred to as sludge. Sludge may develop in any of the areas listed hereinabove. Accumulation of sludge in a BID unit may substantially reduce the useful lifespan of a BID unit. Substantially less sludge may accumulate in apparatus 300 compared with a BID unit which does not comprise first and second layers 364 and 366, and/or sludge may accumulate much more slowly in apparatus 300 than in a BID unit which does not comprise first and second layers 364 and 366. For example, less sludge may develop between the ink developer electrode 350 and the inner surface of the tray 360, and/or in between the cleaning unit 330 and the inner surface of the tray 360, and/or on components of the cleaning unit 330.

It has been observed that, in use, a thin layer of ink particles may adhere to the surface of the layered structure of a BID unit of the present disclosure, the layer of ink particles having a thickness of less than 50 μm, 10 μm, 1 μm. However, no further substantial accumulation of sludge may be observed. Without being bound by theory, it is believed that the thin layer of ink particles may augment the electrical insulation provided by the first layer 364.

In use (for example, when ink is being supplied to the developer roller 326, components of the apparatus 300 may have an electrical potential $V_i$. For example, the ink developer electrode 350 may have a potential $V_{ei}$ of approximately 1000V, the squeezer roller 338 may have a potential $V_{sq}$ of approximately 300V, the cleaning roller 332 may have a potential $V_{cl}$ of approximately 100V, and the wiper 334 and wiper wall 340 may have a potential $V_{wi}$ of approximately 200V. The potential of these components may in some examples contribute to the accumulation of sludge near those components.

Figure 4:
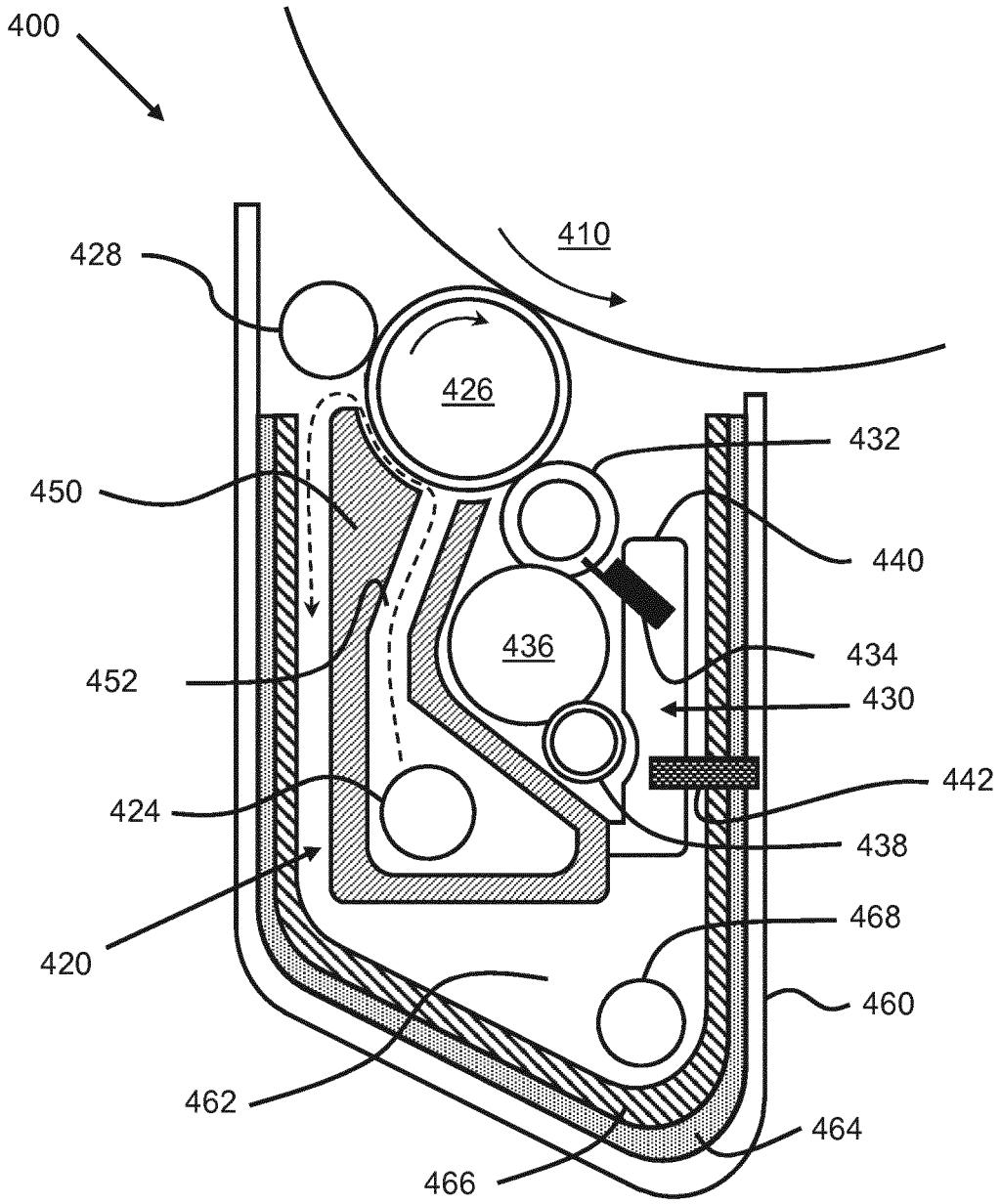

FIG. 4 shows an apparatus 400 according to another example of the present disclosure. The apparatus 400 is a BID unit. For brevity, features in FIGS. 4 and 5, the functions thereof that are the same as those features already described with reference to FIG. 3, are given similar reference numerals to those in FIG. 3 but increased by multiples of 100. Apparatus 400 comprises an electrical conductor 442. The electrical conductor 442 may connect a component of the cleaning unit 430 to the tray 460, thereby allowing electrons to flow between a component of cleaning unit 430 and the tray 460. The electrical conductor 442 may connect any component of the cleaning unit 430 to the tray 460; the apparatus 400 of FIG. 4 shows the electrical conductor 442 connecting a wiper wall 440 with a first layer 464. This connection may result in a wiper 434 and wiper wall 440 having a lower potential $V_{wi}$ compared with an example not comprising an electrical conductor 442. Accordingly, in this example, less sludge may accumulate on or near the wiper 434 and wiper wall 440 compared with an example wherein the apparatus 400 does not comprise an electrical conductor 442 connecting the wiper wall 440 to the tray 460.

Figure 5:
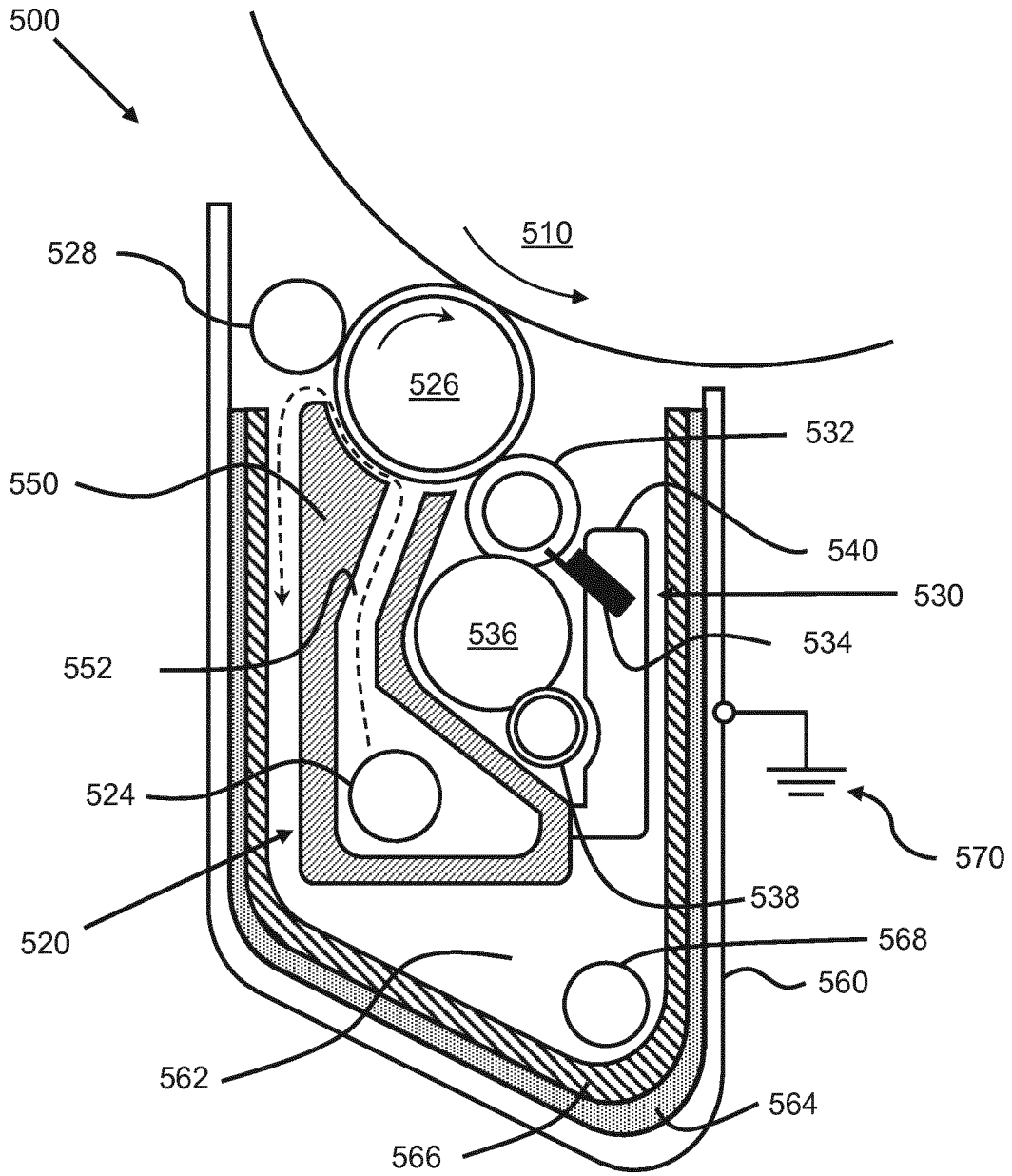

FIG. 5 shows an apparatus 500 according to another example of the present disclosure. The apparatus 500 is a BID unit. It may be desirable to connect a tray 560 to a ground 570 as shown. That is, it may be desirable for the tray 560 to have a potential $V_{tr}$ of 0V. This may increase user safety, and may reduce the likelihood of a user touching the apparatus 500 in use and receiving an electric shock.

It may be that, if a first layer 564 was not present in the apparatus 500, it would be less desirable to connect a part of the tray 560 to the ground 570. For example, without the first layer 564, connecting the tray 560 to the ground 570 could provide a large potential difference between an ink developer electrode 550 and the tray 560, which could in turn encourage sludge accumulation in the apparatus 500.

However, by including the first layer 564, the tray 560 may be electrically connected to the ground 570 without providing a large potential difference between the ink developer electrode 550 and the tray 560, as the first layer 564 may at least partially inhibit the flow of electrons between the ink developer electrode 550 and the tray 560 which is connected to the ground 570. Accordingly, apparatus 500 as shown in FIG. 5 may provide a reduced likelihood of a user electrocution compared with BID units which do not comprise the first layer 564.

Figure 6:
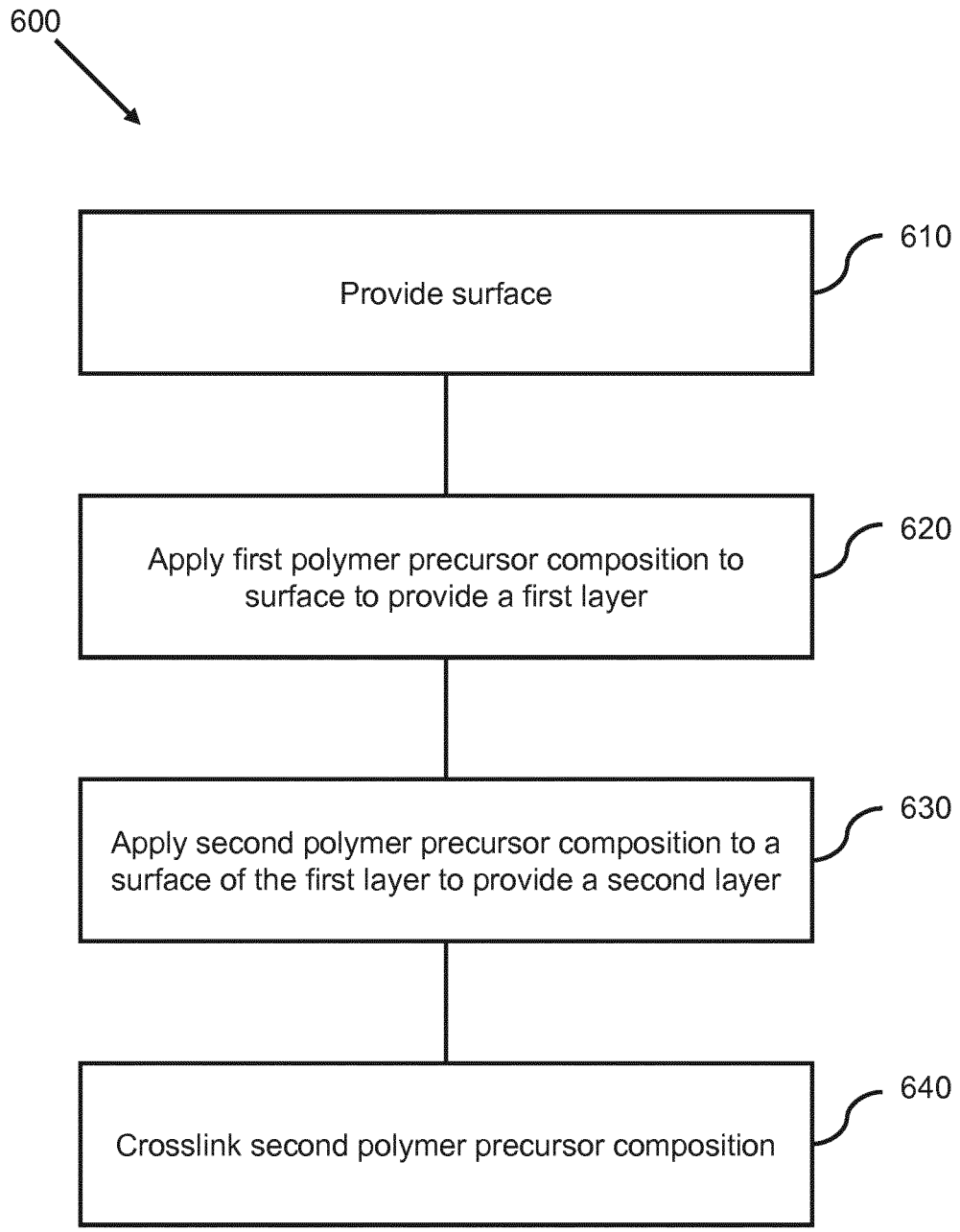
FIG. 6 is a flowchart showing a method of manufacturing a surface of a BID unit in accordance with an example of the present disclosure.

FIG. 6 shows a method 600 of manufacturing a layered structure for use in a BID unit of the present disclosure. The method 600 may first comprise providing a surface 610. The surface may correspond to the internal surface of a tray of a BID unit. In one example, the tray may be ready-formed to provide a cavity, and provide the approximate shape of the BID unit. In another example, the surface may be substantially flat, and/or not be provided in the shape of a BID unit; in this example, the surface may be shaped after the layered structure has been manufactured to provide a cavity and provide the approximate shape of a BID unit.

The method then comprises in block 620 applying a first polymer precursor composition to the surface to provide a first layer. The first polymer precursor composition may be any composition as described hereinabove. In some examples, the first polymer precursor may be an epoxy precursor composition.

In some examples, the first polymer precursor composition may be applied to the surface with an electrostatic spray gun. In some examples, the first polymer precursor composition may be provided as a powder. In these examples the powder may be applied to the surface with a powder electrostatic spray gun. Applying a powder first polymer precursor composition with a powder electrostatic spray gun may provide a first layer of substantially uniform thickness. In other examples, the first polymer precursor composition may be provided as a liquid. In these examples, the liquid may be applied to the surface by spraying, brushing, or rolling the composition onto the surface. In an example, the composition may be applied with a liquid coating spray gun. In another example, the surface may be dipped into a reservoir of precursor composition (dip coating).

Block 620 may comprise applying the first polymer precursor composition to the surface to provide a first layer with a thickness of 1 μm to 1 mm, or from 5 μm to 500 μm, or from 10 μm to 250 μm, or from 50 μm to 200 μm, or from 100 μm to 150 μm. The first polymer precursor composition may be applied to the surface to provide a first layer with a thickness of more than or equal to 1 μm, or 5 μm, or 10 μm, or 50 μm, or 100 μm, or 150 μm. The first polymer precursor composition may be applied to the surface to provide a first layer with a thickness of less than or equal to 500 μm, or 250 μm, or 200 μm, or 150 μm, or 100 μm.

The surface may or may not be cleaned before carrying out block 620. For example, the surface may be cleaned with isopropyl alcohol before carrying out block 620. In an example, the surface is cleaned before carrying out block 620.

The surface may or may not be chemically treated to increase adhesion before carrying out block 620. For example, the surface may be treated with a chromate conversion coating. In an example, the surface is not chemically treated to increase adhesion before carrying out block 620; the surface is not treated with a chromate conversion coating before carrying out block 620. Such a surface may be referred to as an untreated surface. For the avoidance of doubt, chemically treating a surface to increase adhesion may not be the same as cleaning the surface.

The method 600 then comprises in block 630 applying a second polymer precursor composition to a surface of the first layer to produce a second layer. The second layer polymer precursor composition may be any second layer polymer precursor composition as described hereinabove. In an example, the second layer polymer precursor composition is a polyurethane precursor composition, such as a silicone-modified polyurethane precursor composition.

After block 620 and before block 630 components of the first polymer precursor composition may or may not crosslink. In an example, the components of the first polymer precursor composition are crosslinked to provide a first polymer composition before block 630. For example, an epoxy component and a crosslinking agent may crosslink to provide an epoxy resin before block 630.

The crosslinking of components in the first polymer precursor composition may be achieved through applying an external stimulus to the composition. For example, application of an external stimulus may comprise application of heat and/or ultraviolet radiation to the first polymer precursor composition. However, an external stimulus may not be applied to the first polymer precursor layer before block 630. For example, the components of the first polymer precursor composition may crosslink to provide a dielectric layer without application of an external stimulus. The first polymer precursor composition may be an epoxy precursor composition; in this example, an epoxide component and a crosslinking agent may crosslink without application of an external stimulus. Not applying an external stimulus to the first polymer precursor composition between block 620 and block 630 may provide a simple and quick method of manufacturing a layered surface.

Regarding block 630, in some examples the second layer polymer precursor composition may be applied to the surface of the first layer with a spray gun. In an example, the second layer polymer precursor composition is provided as a liquid. In these examples, the liquid may be applied to the surface by spraying, brushing, or rolling the composition onto the first layer. In an example, the composition may be applied with a liquid coating spray gun. The spray gun may or may not be an electrostatic spray gun. In an example, the spray gun is not an electrostatic spray gun. In another example, the first layer may be dipped into a reservoir of precursor composition (dip coating).

Block 630 may comprise applying the second layer polymer precursor composition to the surface of the first layer to provide a second layer with a thickness of 0.1 μm to 500 μm, or from 0.5 μm to 250 μm, or from 1 μm to 100 μm, or from 10 μm to 50 μm, or from 20 μm to 30 μm. The second polymer precursor composition may be applied to the surface to provide a second layer with a thickness of more than or equal to 0.1 μm, or 0.5 μm, or 1 μm, or 5 μm, or 10 μm, or 15 μm, or 20 μm, or 30 μm. The second polymer precursor composition may be applied to the surface to provide a second layer with a thickness of less than or equal to 500 μm, or 250 μm, or 100 μm, or 50 μm, or 30 μm, or 20 μm, or 10 μm. In an example, block 630 may comprise applying the second polymer precursor composition to the surface of the first layer to provide a second layer with a thickness less than the thickness of the first layer.

The method 600 then comprises in block 640 crosslinking the second polymer precursor composition to provide a second layer comprising a polymer composition. The polymer composition may be any second polymer composition as described hereinabove. In an example, the second polymer composition comprises polyurethane, such as silicone-modified polyurethane.

Block 640 may comprise applying an external stimulus to the second polymer precursor composition as described hereinabove. For example, heat and/or ultraviolet light may be applied to the second layer polymer precursor composition, thereby crosslinking the precursor composition to provide a polymer. In an example, the external stimulus may comprise heating the second layer polymer precursor composition at a temperature of from 30 to 150° C., or 50 to 120° C., or 60 to 100° C. The precursor composition may be heated at a temperature greater than or equal to 30, 50, 60 80, or 100° C. The precursor composition may be heated at a temperature less than or equal to 150, 120, 100, 80, 60, or 50° C. In an example, the precursor may be heated at approximately 60° C., or approximately 100° C. The precursor composition may be heated for a duration of from 1 to 5 hour(s), or from 2 to 3 hours. The precursor composition may be heated for a duration greater than or equal to 1, 2, 3, 4 or 5 hour(s). The precursor composition may be heated for a duration less than or equal to 5, 4, 3, 2, or 1 hour(s). In an example, for instance wherein the precursor composition comprises a polyurethane precursor composition (such as a silicon-modified polyurethane precursor composition), the precursor composition may be heated to approximately 100° C. for approximately 4 hours.

After application of an external stimulus, the second layer may be left for a further period to dry and/or reduce the tackiness of the layer to the touch.

Figure 7A:
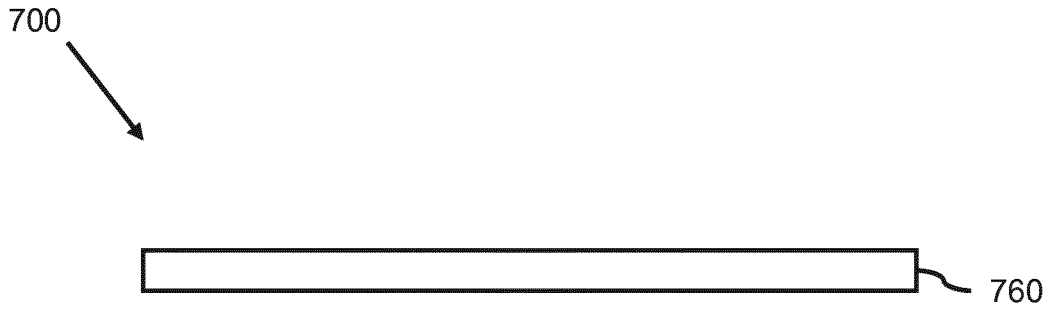
FIGS. 7*a*, 7*b* and 7*c* are schematic diagrams showing a surface of a BID unit at different points of its manufacture in accordance with an example of the present disclosure.
Figure 7B:
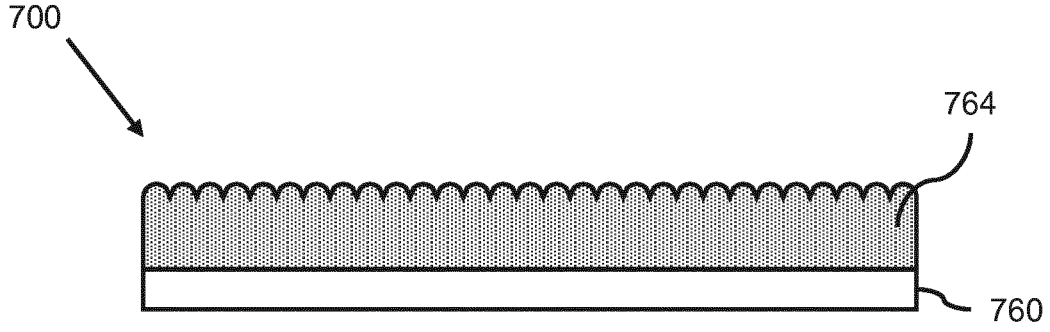
Figure 7C:
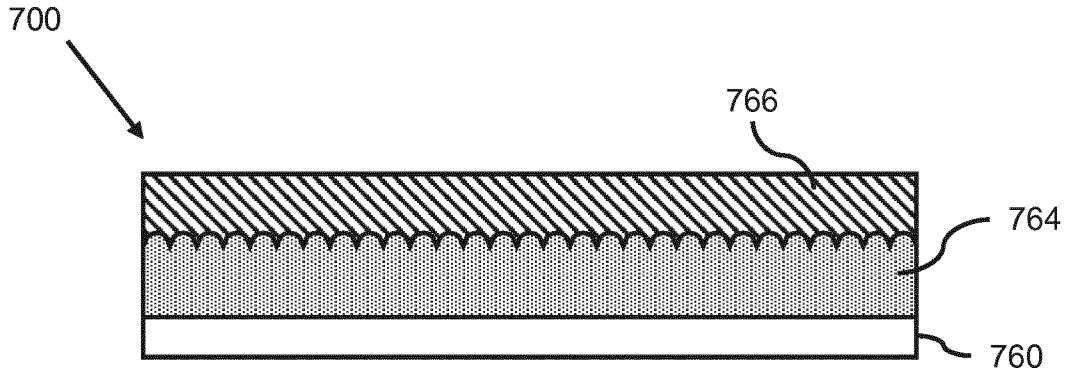

FIGS. 7*a*, 7*b* and 7*c* are schematic diagrams showing a layered structure 700 at different points of its manufacture. FIG. 7*a* shows a surface 760, which may correspond to the internal surface of a tray of a BID unit.

FIG. 7*b* shows a first layer 764 having been applied to the surface 760. The first layer 764 may comprise a first polymer composition, such as an epoxy resin. Layers comprising the first polymer composition may have uneven surfaces, surfaces with high surface energy, surfaces with high friction (large friction coefficient), or surfaces with high wetting (small wetting angle). If an ink were disposed on such a surface of first layer 764, it may adhere strongly to the surface, resulting in sludge. This may in part relate to the nature of the first polymer composition. For example, a layer comprising an epoxy resin may allow for strong adhesion of ink to its surface. This may alternatively or additionally relate to the physical form of the first polymer precursor composition when applied to the surface: for example, an epoxy precursor composition applied as a powder may provide a layer with an uneven surface. Accordingly, if a layered structure 700 is to be exposed to an ink in a BID unit, applying a further layer on top of the first layer 764 may reduce the amount of ink which may adhere to the surface of the layered structure.

FIG. 7*c* shows a second layer 766 having been applied to a surface of the first layer 764. Second layer 766 may adhere strongly to the first layer 764, but provide a top surface to which ink does not adhere strongly; the second layer 766 may be resistant to the adhesion of ink. Polymer compositions as described hereinabove may be used to provide a second layer 766 which adheres to the surface of first layer 764 but is resistant to the adhesion of ink. In some examples, the polymer compositions as described herein may be applied to and adhere to the first layer 764 without any treatment being applied to the first layer 764.

Figure 8:
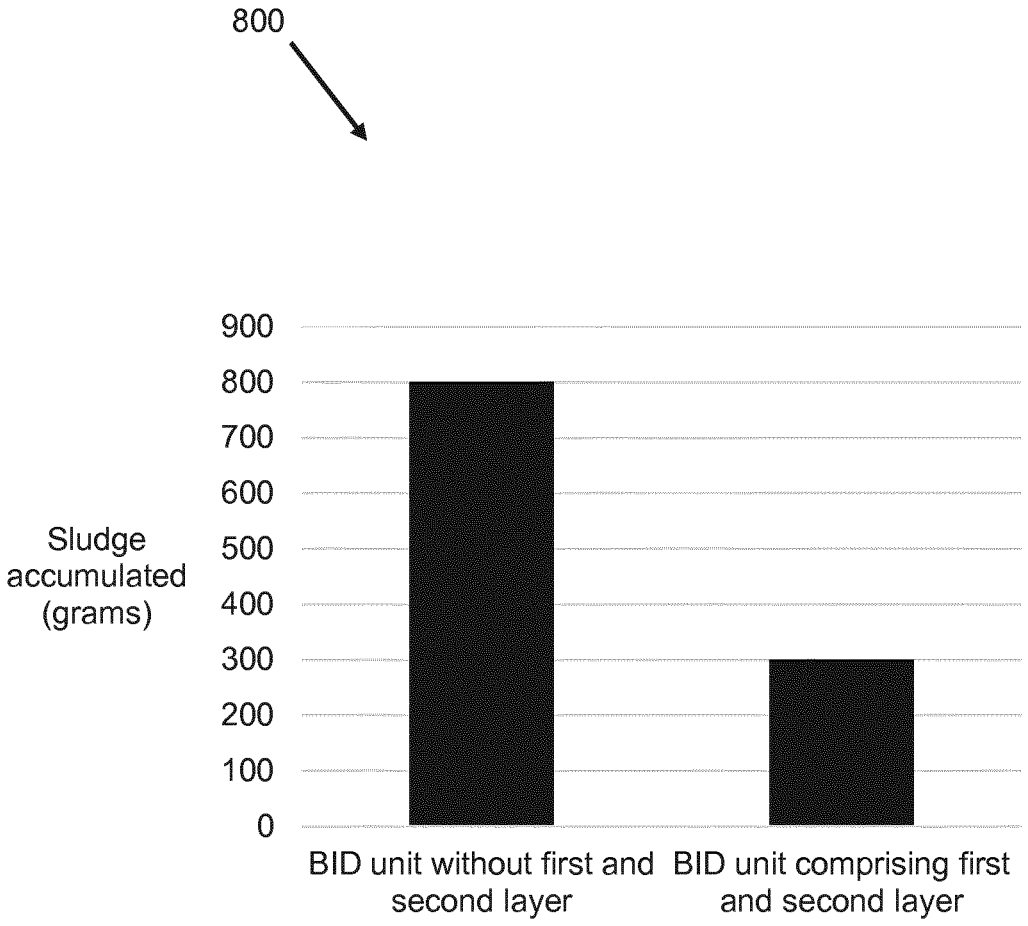
FIG. 8 is a chart comparing sludge accumulation in BID units.

FIG. 8 is a chart 800 comparing the sludge accumulation in a BID unit without a first or second layer as described herein with a BID unit of the present disclosure comprising a first and second layer as described herein. The data shown in FIG. 8 represents the accumulation of sludge in a BID unit after 1,000,000 impressions of an electrographic printer; that is, the accumulation of sludge in a BID unit after the transfer member of the electrographic printer has transferred an image from the transfer member to a substrate 1,000,000 times. The number of impressions may correspond to the number of times the BID unit has transferred a printing substance to a photo-imaging cylinder. FIG. 8 shows that less sludge may accumulate in a BID unit of the present disclosure over time/number of impressions. For example, a BID unit of the disclosure may accumulate 10%, 20%, 30%, 40%, 50%, or 60% less sludge by mass than a BID unit without a first and second layer as described herein.

A further example of the present disclosure is an electrographic printer comprising a layered structure. The layered structure may correspond to any of those described herein. For example, the layered structure may comprise a surface, a first layer disposed on the surface, the first layer comprising [epoxy-phenol], and a second layer disposed on the first layer, the second layer comprising a second layer polymer composition.

In an example, the layered structure is disposed in a binary ink development unit. For example, the layered structure may be disposed in any BID unit according to the present disclosure. Put another way, an example of the present disclosure is an electrographic printer comprising a BID unit as described herein.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. An apparatus for use in an electrographic printer, the apparatus comprising:

a tray defining a cavity, the tray having an internal surface;

an ink developer electrode disposed in the cavity for developing an ink;

a first layer disposed on the internal surface, the first layer comprising a dielectric material; and a second layer disposed on the first layer, the second layer adhering to the first layer and being resistant to the adhesion of ink.

2. The apparatus of claim 1, wherein the dielectric material comprises an epoxy resin.

3. The apparatus of claim 1, wherein the first layer has a thickness of from 1 μm to 1 mm.

4. The apparatus of claim 1, wherein the second layer comprises at least one of: a polyurethane, a polyester, a silicone, and combinations thereof.

5. The apparatus of claim 1, wherein the second layer has a thickness of from 0.5 μm to 500 μm.

6. The apparatus of claim 1, wherein the dielectric material comprises an epoxy resin obtainable from a bisphenol polyphenol and the second layer comprises a silicone-modified polyurethane.

7. The apparatus of claim 1, wherein the first layer is electrically grounded.

8. The apparatus of claim 1, wherein the apparatus comprises a cleaning unit having one or more components, and the first layer is connected to one or more components of the cleaning unit by an electrical conductor.

9. A method of manufacturing an apparatus for use in an electrographic printer, the method comprising:

(a) providing a surface;

(b) applying a first polymer precursor composition, thereby providing a first layer;

(c) applying a second polymer precursor composition to a surface of the first layer, thereby providing a second layer; and (d) crosslinking the second polymer precursor composition.

10. The method according to claim 9, wherein the surface is an untreated surface.

11. The method according to claim 9, wherein the first polymer precursor composition is provided as a powder and the second polymer precursor composition is provided as a liquid.

12. The method according to claim 9, comprising applying the first polymer precursor composition with an electrostatic spray gun.

13. The method according to claim 9, comprising applying the second polymer precursor composition with a liquid coating spray gun.

14. An electrographic printer comprising a layered structure, the layered structure comprising:

a substrate having a surface;

a first layer disposed on the surface of the substrate, the first layer comprising an epoxy resin; and a second layer disposed on the first layer, the second layer comprising at least one of: a polyurethane, a polyester, a silicone, and combinations thereof.

15. The electrographic printer of claim 14, wherein the layered structure is disposed in a binary ink development unit.

* * * * *